US005697813A

United States Patent [19]

Ikeda

[11] Patent Number: 5,697,813

[45] Date of Patent: Dec. 16, 1997

[54] CONNECTION TERMINAL

[75] Inventor: Tomohiro Ikeda, Shizuoka, Japan

[73] Assignee: Yazaki Corporation, Tokyo, Japan

[21] Appl. No.: 205,061

[22] Filed: Mar. 3, 1994

[30] Foreign Application Priority Data

Mar. 3, 1993 [JP] Japan ..... HEI. 5-065933

[51] Int. Cl.[6] ..... H01R 13/40

[52] U.S. Cl. ..... 439/595; 439/745

[58] Field of Search ..... 439/595, 745, 439/746, 744

[56] References Cited

U.S. PATENT DOCUMENTS

| | | | |
|---|---|---|---|
| 3,031,640 | 4/1962 | McKee | 439/745 OR |
| 3,421,136 | 1/1969 | Bowley et al. | 439/745 OR |
| 5,240,434 | 8/1993 | Yagi et al. | 439/595 OR |
| 5,261,834 | 11/1993 | Yamanashi | 439/595 OR |
| 5,342,219 | 8/1994 | Onodera et al. | 439/595 OR |

*Primary Examiner*—P. Austin Bradley
*Assistant Examiner*—Daniel Wittels
*Attorney, Agent, or Firm*—Sughrue, Mion, Zinn, Macpeak & Seas, PLLC

[57] ABSTRACT

To provide a connection terminal which can be mounted with an improved operation efficiency, and has sufficient retaining force and strength, a front end portion of a connection terminal is constituted by side plate portions formed by substantially perpendicularly bending opposite side portions of a developed material along a longitudinal direction which developed material is stamped by a die from an electrically-conductive metal plate having spring properties, and resilient contact piece portions formed respectively by inwardly bending front end portions of these side plate portions. A retaining hole for receiving an elastic lance provided in a terminal receiving chamber of a connector is formed through a base plate portion disposed between the opposite side plate portions. A conductor clamping portion and a wire sheath clamping portion, which serve to compressively clamp a connection wire W, are formed at a rear end portion of the connection terminal, the clamping portion as well as the clamping portion being formed by bending extension pieces, extending respectively from the opposite sides of the base plate portion, into a semi-cylindrical shape. Upper end portions of the side plate portions prevent the connection terminal from being erroneously inserted upside down into the terminal receiving chamber of the connector.

7 Claims, 4 Drawing Sheets

CONNECTION TERMINAL

BACKGROUND OF THE INVENTION

This invention relates to a connection terminal which can be inserted into a terminal receiving chamber of a connector with a low insertion force which connector is used for connecting a wire branching off from a wire harness in an automobile or the like.

Generally, in the connection of wires to electrical equipments mounted on an automobile or the like, many connection terminals are used for electrically connecting many wires, branching off from a wiring harness, through a fuse box or the like. For example, as disclosed in Japanese Patent Unexamined Publication No. 56-14459, such a connection terminal is formed by a method in which a strip-like unit, developed material is stamped by a die from a metal plate having spring properties, and this material is shaped. This construction is shown as a first conventional example in FIGS. 5 and 6. A front end portion of a connection terminal 1*a* is constituted by side walls 2, bent substantially perpendicularly respectively from opposite sides of a base plate portion 4, and contact piece portions 3 formed respectively by inwardly bending front end portions of these side walls. A retaining hole 7*a* for receiving a retaining projection 6*a* of an elastic lance 6A formed on a connector housing 5, is formed through the base plate portion 4. A conductor clamping portion 8 and a wire sheath clamping portion 9, which serve to compressively clamp a connection wire W, are formed at a rear end portion of the connection terminal 1*a*.

As shown in FIG. 7, when the connection terminal 1*a* is inserted into the connector housing 5, the projection 6*a* of the lance 6A having a transverse width a and a longitudinal length x is engaged in the retaining hole 7*a* having a transverse width A and a longitudinal length X. Electric current flows from the wire W to the connection terminal 1*a*, and then flows via a blade-type fuse 10 to a connection terminal (not shown), connected to a load, from the connection terminal 1*a* compressively clamping an end portion of the wire W connected to a power source.

As shown in FIG. 8, when the connection terminal 1*a* compressively clamping the power source-side wire W is inserted by applying an insertion force in a direction of arrow D, the elastic lance 6A is urged down, and upon engagement in the retaining hole 7*a*, the lance is returned to its initial position by its restoring force. When the wire W is to be withdrawn in a direction of arrow C, it is necessary to provide a pulling force which will overcome such a retaining force that an edge of the retaining hole 7*a* in the base plate portion 4 is proportional to the transverse width a of the retaining projection 6*a* of the lance 6A.

A second conventional example is shown in FIGS. 9 and 10. This connection terminal 1*b* is the same as the first example except for the shape of a retaining hole 7*b*. More specifically, a transverse width B of the retaining hole 7*b* is equal to an inner width of a base plate portion 4, and is larger than the transverse width A of the retaining hole 7*a* of the first conventional example shown in FIG. 5, and the retaining hole 7*b* has the same longitudinal length X as that of the retaining hole 7*a*. A transverse width b of a retaining projection 6*b* of a lance 6B engageable in the retaining hole 7*b* is larger than the transverse width a of the lance 6A of the first conventional example shown in FIG. 6, and the retaining projection 6*b* has the same longitudinal length x as that of the first conventional example.

A third conventional example is shown in FIGS. 11 and 12. This connection terminal 1C is also the same as the first conventional example except for the shape of a retaining hole 7*c*. More specifically, a transverse width B of the retaining hole 7*c* is equal to that of the second conventional example shown in FIG. 9, and a longitudinal length Y of the retaining hole 7*c* is smaller than the longitudinal length X of the first and second conventional examples. Therefore, a transverse width b of a retaining projection 6*c* of a lance 6C engageable in this retaining hole 7*c* is equal to that of the second conventional example shown in FIG. 10, and a longitudinal length y of the retaining projection 6*c* is smaller than the longitudinal length x of the first and second conventional examples.

Comparing the above dimensional relations, B>A, b>a, X>Y and x>y are provided.

In the above conventional examples, a comparison of an insertion force $F_1$ of the connection terminal, a retaining force $F_2$ for preventing the connection terminal from moving in the direction of withdrawal of the connection terminal, and a mechanical strength $F_3$ of a neck portion of the connection terminal indicates that in the first conventional example, since the retaining projection 6*a* of the lance 6A is small, and has a slanting surface elongated in the longitudinal direction, the insertion force $F_1$ required is small and therefore is good. The retaining hole 7*a* has a small opening area, and therefore there is no problem with the strength $F_3$. However, since the retaining projection 6*a* of the lance 6A is small, there is a problem with the retaining force $F_2$.

In the second conventional example, the retaining projection 6*b* of the lance 6B has a slanting surface elongated in the longitudinal direction as in the above conventional example, and therefore the insertion force $F_1$ is good. The transverse width b is large, and therefore the retaining force $F_2$ is also good. However, since the retaining hole 7*b* with the largest opening area, in which the retaining projection 6*b* is engageable, is formed through the base plate portion 4, the strength $F_3$ is small. Therefore, this construction has drawbacks that the connection terminal is liable to be deformed, and that the cross-sectional area of the electrically-conducting portion is small, so that it is liable to become heated.

In the third conventional example, since the longitudinal length y of the retaining projection 6*c* of the lance 6C is small, the slanting surface is abrupt in the direction of insertion of the connection terminal. And besides, since the transverse width b is large, a large insertion force $F_1$ is required. Therefore, it is necessary to beforehand press down the retaining projection 6*c* by the use of a jig. Thus, there is a problem with the operability.

The present invention has been made in view of the problems of the above conventional examples, and an object of the invention is to provide a connection terminal which can be mounted with an improved operation efficiency, and has sufficient retaining force and strength.

BACKGROUND OF THE INVENTION

The above object of the present invention has been achieved by a connection terminal having a retaining hole in which a retaining lance formed within a housing of a connector is engageable, characterized in that the retaining hole is defined by a rectangular portion, having a transverse width equal to an inner width of a base plate portion of the terminal, and a notched portion formed in a rear long side of the rectangular portion; and a slanting surface portion corresponding to the notched portion is formed at a rear side of an upper end face of a retaining projection formed on a front end portion of the retaining lance engageable in the retaining hole.

In the connection terminal of the present invention, the retaining hole is defined by the rectangular portion, having the transverse width equal to the inner width of the base plate portion of the terminal, and the notched portion formed in the rear long side of the rectangular portion, and the slanting surface portion corresponding to the notched portion is formed at the rear side of the upper end face of the retaining projection formed on the front end portion of the retaining lance engageable in the retaining hole. With this construction, when the connection terminal is inserted, the lance having the slanting surface portion is easily urged downward, and therefore the insertion of the terminal can be effected with a small force. Furthermore, the transverse width of the retaining hole is equal to the inner width of the base plate portion, and the transverse width of the retaining projection of the corresponding lance can be made large, and therefore the maximum retaining force can be obtained without lowing the strength of the connection terminal.

DESCRIPTION OF THE PREFERRED EMBODIMENTS

Figure 1:
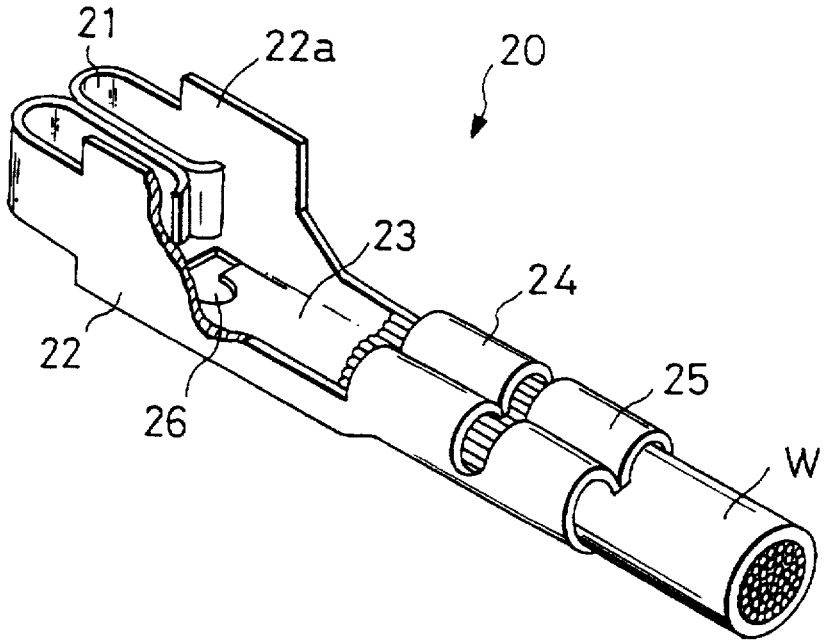
FIG. 1 a perspective view of one preferred embodiment of a connection terminal of the present invention.

One preferred embodiment of a connection terminal of the present invention will now be described in detail with reference to the drawings. FIG. 1 is a perspective view of one preferred embodiment of a connection terminal of the present invention, FIG. 2 is a plan view of the terminal of FIG. 1, FIG. 3 is an enlarged perspective view of an important portion of a lance of the present invention, and FIG. 4 is a cross-sectional view showing a condition in which the connection terminal is fitted in a connector.

As shown in FIG. 1, a front end portion of the connection terminal 20 is constituted by side plate portions 22 formed by substantially perpendicularly bending opposite side portions of a developed material along a longitudinal direction which developed material is stamped by a die from an electrically-conductive metal plate having spring properties, and resilient contact piece portions 21 formed respectively by inwardly bending front end portions of these side plate portions. A retaining hole 26 for receiving an elastic lance (later described) provided in a terminal receiving chamber of a connector is formed through a base plate portion 23 disposed between the opposite side plate portions 22. A conductor clamping portion 24 and a wire sheath clamping portion 25, which serve to compressively clamp a connection wire W, are formed at a rear end portion of the connection terminal 20, the clamping portion 24 as well as the clamping portion 25 being formed by bending extension pieces, extending respectively from the opposite sides of the base plate portion 23, into a semi-cylindrical shape. Upper end portions **22*a* of the side plate portions 22 prevent the connection terminal 20** from being erroneously inserted upside down into the terminal receiving chamber of the connector.

Figure 2:
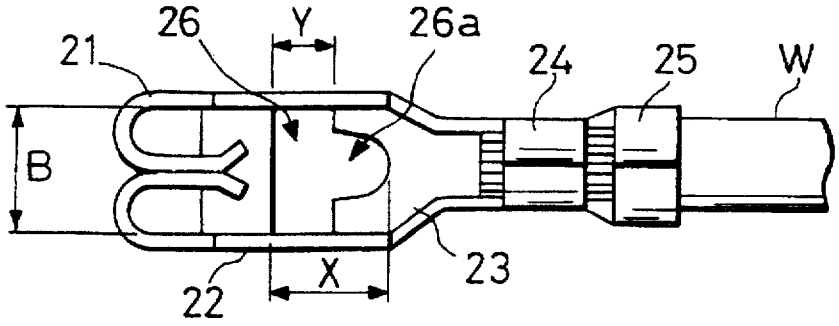
FIG. 2 is a plan view of the terminal of FIG. 1.

As shown in FIG. 2, the retaining hole 26 according to the present invention has a generally T-shaped configuration defined by a rectangular portion, having a long side length B substantially equal to an inner width of the base plate portion 23 and a short side length Y, and a semi-oval portion **26*a*** extending from the rear long side of the rectangular portion. This retaining hole has a longitudinal length X.

Figure 3:
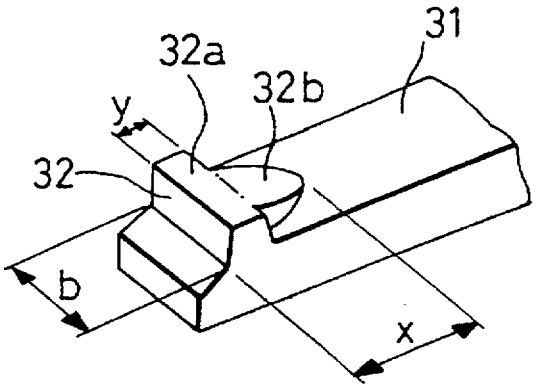
FIG. 3 is an enlarged perspective view of an important portion of a lance of the present invention.
Figure 4:
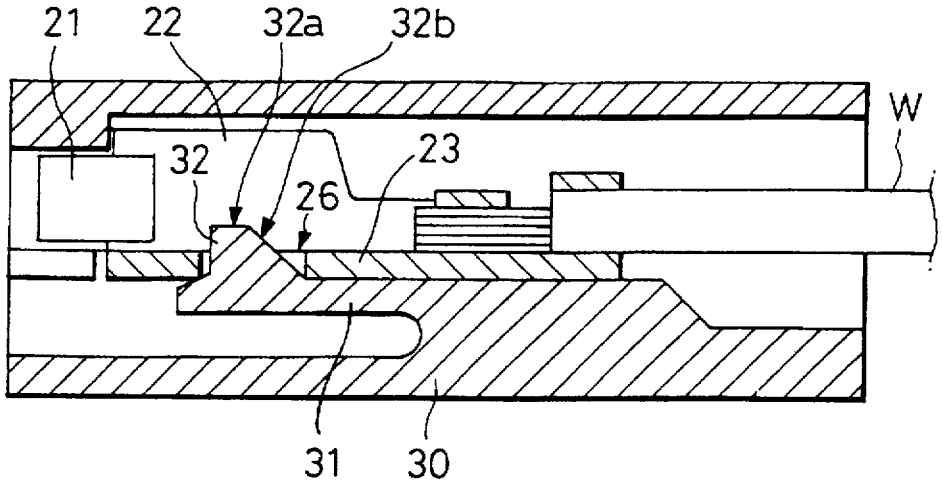
FIG. 4 is a cross-sectional view showing a condition in which the terminal is fitted in a connector.
Figure 5:
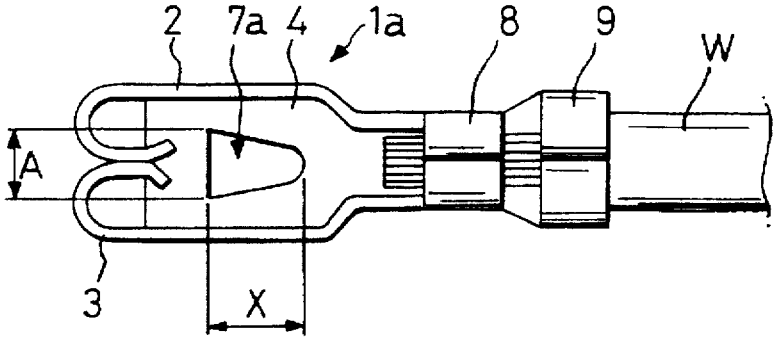
FIG. 5 PRIOR ART
FIG. 5 is a plan view of a first conventional example.
Figure 6:
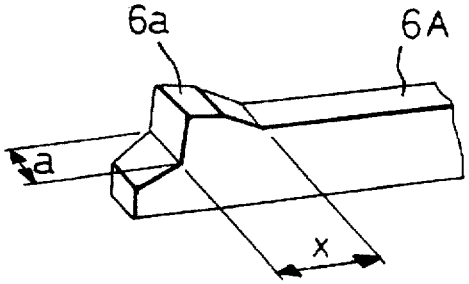
FIG. 6 PRIOR ART
FIG. 6 is an enlarged perspective view of an important portion of a lance for cooperating with the connection terminal of FIG. 5.
Figure 7:
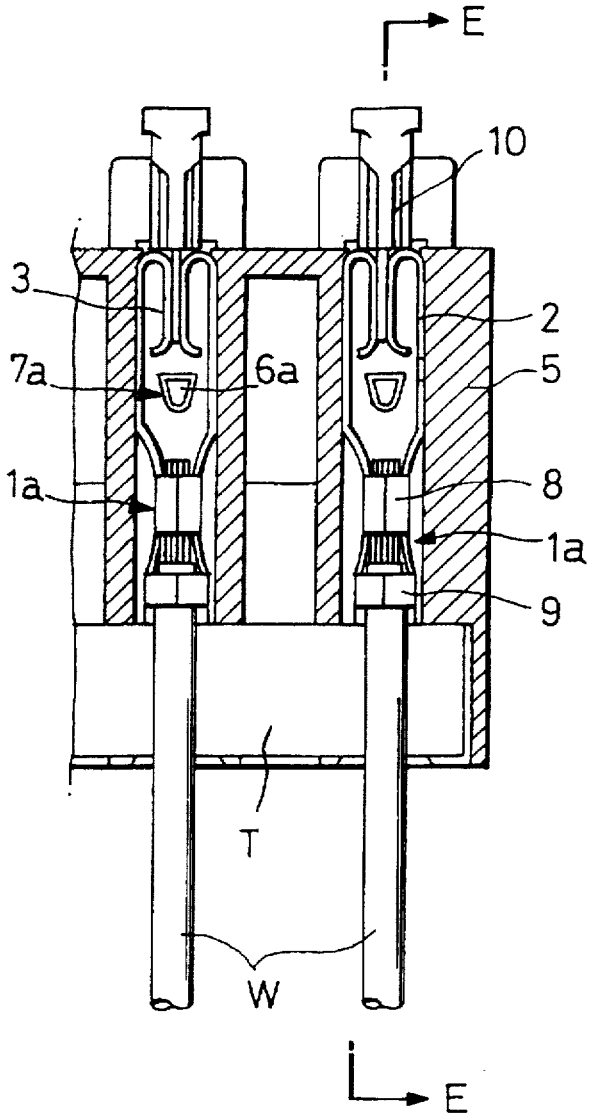
FIG. 7 PRIOR ART
FIG. 7 is a fragmentary cross-sectional view showing a condition in which the connection terminal of the first conventional example is fitted in a connector.
Figure 8:
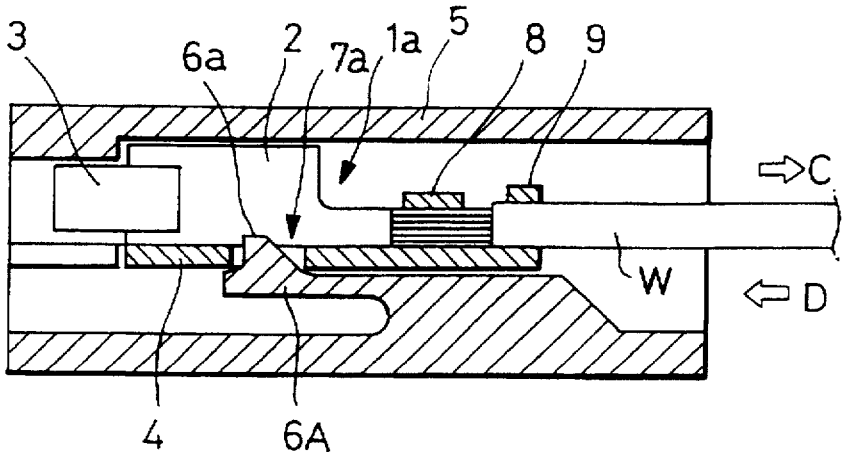
FIG. 8 PRIOR ART
FIG. 8 is a cross-sectional view taken along the line E—E of FIG. 7.
Figure 9:
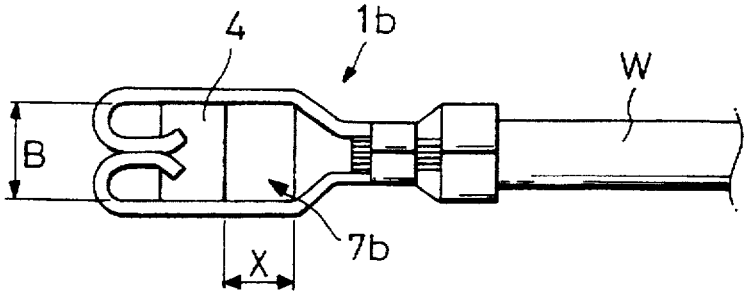
FIG. 9 PRIOR ART
FIG. 9 is a plan view of a second conventional example.
Figure 10:
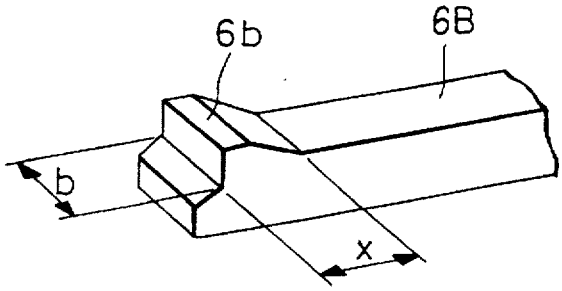
FIG. 10 PRIOR ART
FIG. 10 is an enlarged perspective view of an important portion of a lance for cooperating with the connection terminal of FIG. 9.
Figure 11:
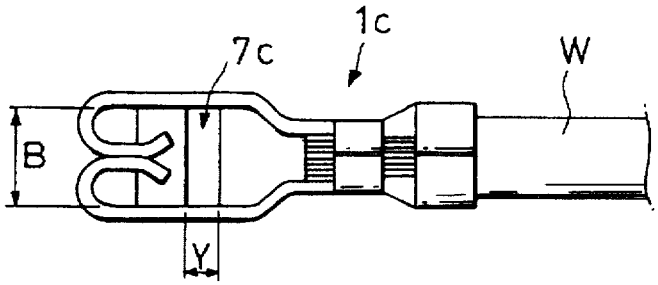
FIG. 11 PRIOR ART
FIG. 11 is a plan view of a third conventional example.
Figure 12:
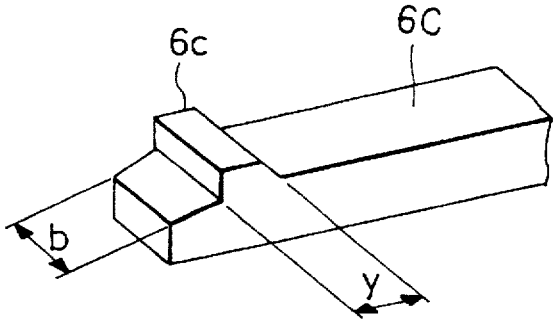
FIG. 12 PRIOR ART
FIG. 12 is an enlarged perspective view of an important portion of a lance for cooperating with the connection terminal of FIG. 11.

As shown in FIG. 3, a retaining projection 32 of a retaining lance 31 according to the present invention has such a configuration that a slanting surface portion **32*b* of a semi-oval shape is provided in contiguous relation to a rear long side of a rectangular upper end face 32*a*, and the retaining projection 32 has a longitudinal length x, and the length of the long side of the upper end face 32*a*** is equal to a transverse width b of the retaining projection.

The cross-sectional view of FIG. 4 shows a condition in which the retaining hole 26 is fitted on the retaining projection 32 of the retaining lance 31, provided within a connector housing, with a low insertion force.

The area of opening of the retaining hole 26 of the connection terminal 20 of this embodiment described above is smaller than the area of opening of the retaining hole **7*b* of the above-mentioned second conventional example, and the semi-oval portion 26*a* is spaced from the opposite side plate portions 22. Therefore, a strength $F_3$ of a neck portion of the connection terminal 20 is higher than the strength $F_3$ of the second conventional example having the retaining hole 7*b*, and the connection terminal 20** is less liable to be deformed.

The transverse width b of the retaining projection 32 of the retaining lance 31 engageable in the retaining hole 26 is large, as is the case with the retaining projection **6*b* of the second conventional example and the retaining projection 6*c* of the third conventional example, and therefore a retaining force $F_2$ for the connection terminal 20** is good.

The slanting surface portion **32*b* of a semi-oval shape disposed in contiguous relation to the rear long side of the upper end face 32*a* of the retaining projection 32 is formed into a gently-slanting surface, and therefore when the connection terminal 20 is inserted, the retaining projection 32 of the elastic lance 31 is easily urged downward, so that an insertion force $F_1$ required is small as is the case with the connection terminal 1*a* of the first conventional example and the connection terminal 1*b* of the second conventional example, and the connection terminal 20** can be inserted with a low insertion force.

As described above, the connection terminal of this embodiment can achieve the fitting condition, providing a high retaining force, with a low insertion force, and is of such a construction that the neck portion has a sufficient strength.

As described above, the connection terminal of the present invention can be inserted into the connector housing with a low insertion force, and therefore the efficiency of the mounting operation is enhanced, and besides because of a high retaining force for the connection terminal, a disadvantage such as withdrawal of the connection terminal is prevented, and since a sufficient strength of the neck portion of the terminal is secured, there can be provided the good terminal less susceptible to deformation.

What is claimed is:

1. In a connection terminal assembly having a retaining hole in which a retaining lance formed within a housing of a connector is engageable, the improvement wherein said retaining hole is defined by a primary portion, having a transverse width and a notched portion formed in a rear side of said primary portion; and a slanting surface portion corresponding to said notched portion is formed on a retaining projection formed on said retaining lance engageable in said retaining hole.

2. The assembly of claim 1, wherein said primary portion is physically continuous with said notch portion.

3. The assembly of claim 1, wherein a transverse width of said notch portion is substantially smaller than said transverse width of said primary portion.

4. The assembly of claim 1, wherein said transverse width of said primary portion is substantially equal to an inner width of a base plate portion of a terminal.

5. The assembly of claim 1, wherein said primary portion has a substantially rectangular shape.

6. In a connection terminal having a retaining hole in which a retaining lance formed within a housing of a connector is engageable, the improvement wherein said retaining hole is defined by a primary portion having a transverse width and a notched portion formed in a rear side of said primary portion and having a transverse width; said primary portion is physically continuous with said notch portion; and said transverse width of said notch portion is smaller than said transverse width of said primary portion.

7. The connection terminal of claim 6, wherein said primary portion has a substantially rectangular shape.

* * * * *